US009121124B2

(12) United States Patent
Bomar et al.

(10) Patent No.: US 9,121,124 B2
(45) Date of Patent: Sep. 1, 2015

(54) VERTICAL AXIS WASHING MACHINE APPLIANCE WITH FEATURES FOR APPLYING STEAM TO ARTICLES AND RELATED METHODS

(75) Inventors: Blake Philip Bomar, Louisville, KY (US); Michelle Diana Gross, Louisville, SC (US); Brett Farris, Louisville, KY (US)

(73) Assignee: General Electric Company, Schenectady, NY (US)

( * ) Notice: Subject to any disclaimer, the term of this patent is extended or adjusted under 35 U.S.C. 154(b) by 119 days.

(21) Appl. No.: 13/353,609

(22) Filed: Jan. 19, 2012

(65) Prior Publication Data

US 2013/0185873 A1 Jul. 25, 2013

(51) Int. Cl.

| | |
|---|---|
| ***D06F 17/12*** | (2006.01) |
| ***D06F 23/04*** | (2006.01) |
| ***D06F 39/00*** | (2006.01) |
| ***D06F 39/04*** | (2006.01) |
| ***D06F 39/08*** | (2006.01) |

(52) U.S. Cl.

CPC ..... *D06F 39/04* (2013.01); *D06F 17/12* (2013.01); *D06F 23/04* (2013.01); *D06F 39/008* (2013.01); *D06F 39/08* (2013.01); *D06F 39/083* (2013.01); *D06F 39/088* (2013.01)

(58) Field of Classification Search

CPC ..... D06F 39/04; D06F 39/083

See application file for complete search history.

(56) References Cited

U.S. PATENT DOCUMENTS

| | | | | |
|---|---|---|---|---|
| 2007/0283506 | A1* | 12/2007 | Wong et al. | 8/149.3 |
| 2008/0040871 | A1 | 2/2008 | Wong et al. | |
| 2008/0289117 | A1* | 11/2008 | Lee | 8/149.1 |
| 2010/0000269 | A1* | 1/2010 | Shin et al. | 68/5 C |
| 2010/0200019 | A1 | 8/2010 | Prioli | |

* cited by examiner

*Primary Examiner* — Michael Barr
*Assistant Examiner* — Levon J Shahinian
(74) *Attorney, Agent, or Firm* — Dority & Manning, P.A.

(57) ABSTRACT

The present subject matter provides a vertical axis washing machine appliance with features for applying steam to articles disposed therein. The washing machine appliance can be configured for filling a sump of the appliance with fluid and activating a pump in order to drain the sump of fluid. After the pump is activated, the washing machine appliance can be configured for submerging a heater in the appliance's sump with fluid and also starting the heater in order to heat the fluid in the sump and generate steam. Related methods are also provided.

10 Claims, 4 Drawing Sheets

VERTICAL AXIS WASHING MACHINE APPLIANCE WITH FEATURES FOR APPLYING STEAM TO ARTICLES AND RELATED METHODS

FIELD OF THE INVENTION

The present subject matter relates generally to washing machine appliances with features for applying steam to articles disposed therein and methods for operating the same.

BACKGROUND OF THE INVENTION

Washing machine appliances can clean articles disposed therein using steam. Steam can increase certain wash cycles' efficiency and effectiveness. For example, steam can decrease the amount of time and/or water needed to clean articles. Also, steam can assist in reducing wrinkles or odors in articles cleaned by such washing machine appliances.

To generate steam, certain washing machines appliances include a steam generator in which steam is generated and subsequently piped to a wash chamber of the appliance. Alternatively certain horizontal axis washing machine appliances generate steam within the appliance's wash chamber. However, currently, certain challenges exist to the use of steam in vertical axis washing machine appliances.

In vertical axis washing machines, the appliance's wash basket rotates about a vertical axis. Because of the wash basket's vertical orientation, fluid within the basket can settle in the basket's sump that is positioned adjacent to a bottom of the basket. Fluid in the appliance's sump can be removed from the sump (e.g., via a pump) at the end of any particular cycle. For example, at the end of the appliance's final rinse cycle, wash fluid in the appliance's sump can be pumped out with a drain pump. However, when the drain pump shuts off, wash fluid can backflow into the sump. For example, wash fluid within the appliance's drain pipe can backflow into the sump due to gravity. The amount of wash fluid that backflows into the sump can be related to a drain pipe's height and/or orientation. However, due to such backflow, wash fluid in the sump during subsequent cycles (e.g., a steam cycle) can have an unknown composition. Such backflow can also affect the amount of wash fluid in the sump during subsequent cycles of the appliance.

Accordingly, a washing machine appliance with features for generating steam within the appliance's wash chamber would be useful. Also, a vertical axis washing machine appliance with features for generating steam within the appliance's wash chamber would be useful. In particular, a vertical axis washing machine appliance with features for controlling the composition and/or amount of fluid converted into steam within the appliance's wash chamber would also be useful.

BRIEF DESCRIPTION OF THE INVENTION

Aspects and advantages of the invention will be set forth in part in the following description, or may be obvious from the description, or may be learned through practice of the invention.

In a first embodiment, a vertical axis washing machine appliance is provided. The washing machine appliance includes a cabinet and a wash tub received in the cabinet. The wash tub is configured for containing a fluid used in a washing process. The wash tub extends between a bottom portion and a top portion. A wash basket is mounted in the wash tub. The wash basket is configured for the receipt of articles during the washing process and for rotation about a substantially vertical axis. A sump is positioned adjacent the bottom portion of the wash tub. The sump is also in fluid communication with the wash tub. A heater is positioned adjacent or within the sump and is configured for selectively adjusting a temperature of fluid in the sump. A valve is configured for permitting selective addition of fluid to the wash tub. A pump is in fluid communication with the sump. The pump is configured for selective draining of fluid from the sump.

In a second embodiment, a method for operating a washing machine appliance is provided. The washing machine has a sump with a heater disposed therein. The method includes filling the sump of the washing machine appliance with fluid, draining the sump of fluid, submerging the heater of the washing machine appliance in fluid after draining the sump, and heating the fluid in the sump with the heater in order to generate steam.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
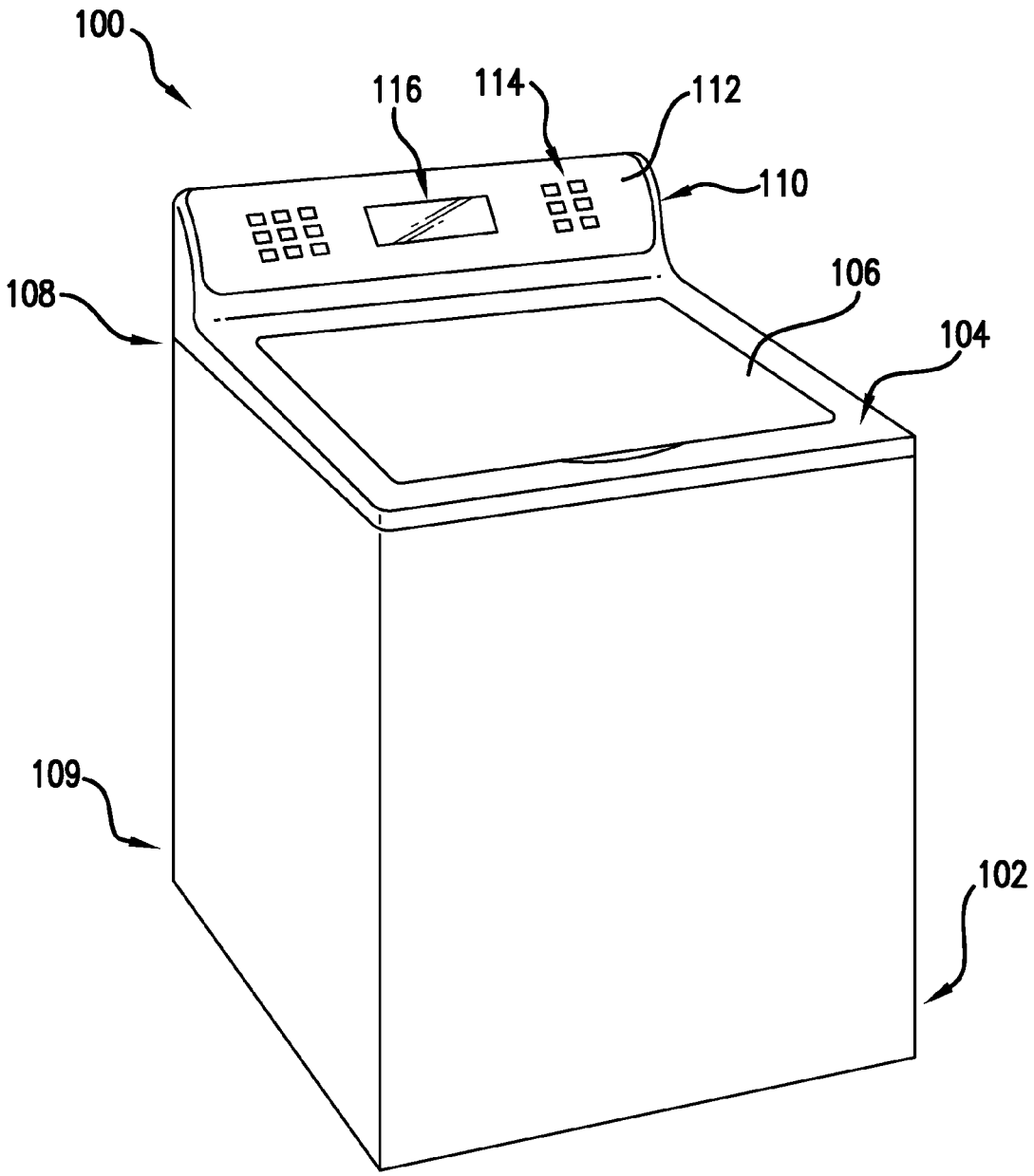
FIG. 1 provides a perspective view of a washing machine appliance according to an exemplary embodiment of the present subject matter.

The present subject matter provides a vertical axis washing machine appliance with features for applying steam to articles disposed therein. The washing machine appliance can be configured for filling a sump of the appliance with fluid and activating a pump in order to drain the sump of fluid. After the pump is activated, the washing machine appliance can be configured for submerging a heater in the appliance's sump with fluid and also starting the heater in order to heat the fluid in the sump and generate steam. Related methods are also provided. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an exemplary vertical axis washing machine 100 including a cabinet 102 and a cover 104. Cabinet 102 extends between a top 108 and a bottom 109. A backsplash 110 extends from cover 104, and a control panel 112 including a plurality of input selectors 114 is coupled to backsplash 110. Control panel 112 and input selectors 114 collectively form a user interface input for operator selection of machine cycles and features, and in one embodiment, a display 116 indicates selected features, a countdown timer, and/or other items of interest to machine users. A lid 106 is mounted to cover 104 and is rotatable about a hinge (not shown) between an open position (not shown) facilitating access to wash tub 120 located within cabinet 102 and a closed position (shown in FIGS. 2 and 3) forming an enclosure over wash tub 120.

Figure 2:
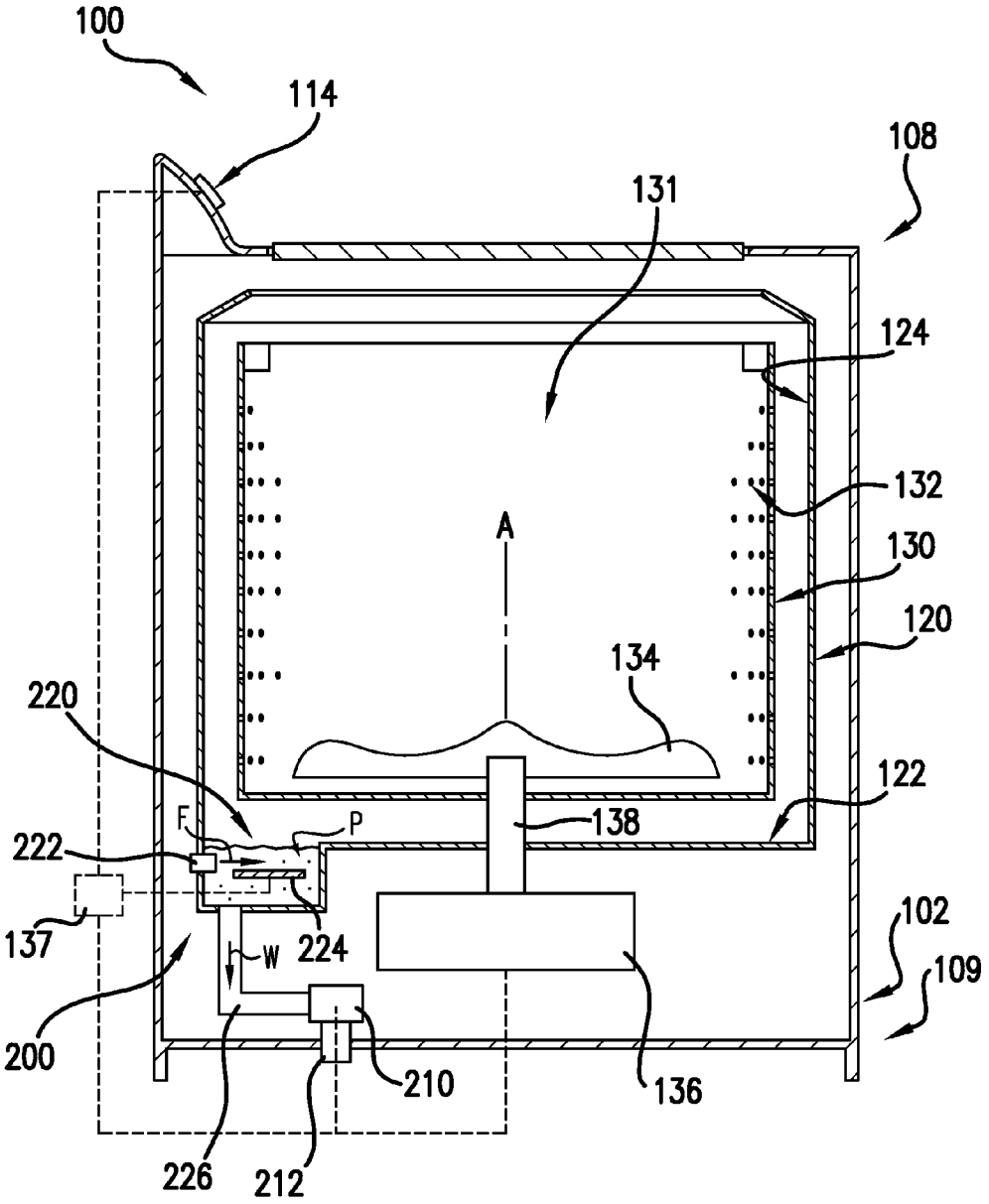
FIG. 2 provides a cross-sectional view of the washing machine appliance of FIG. 1 and particularly illustrates a sump of the appliance filled with wash fluid.
Figure 3:
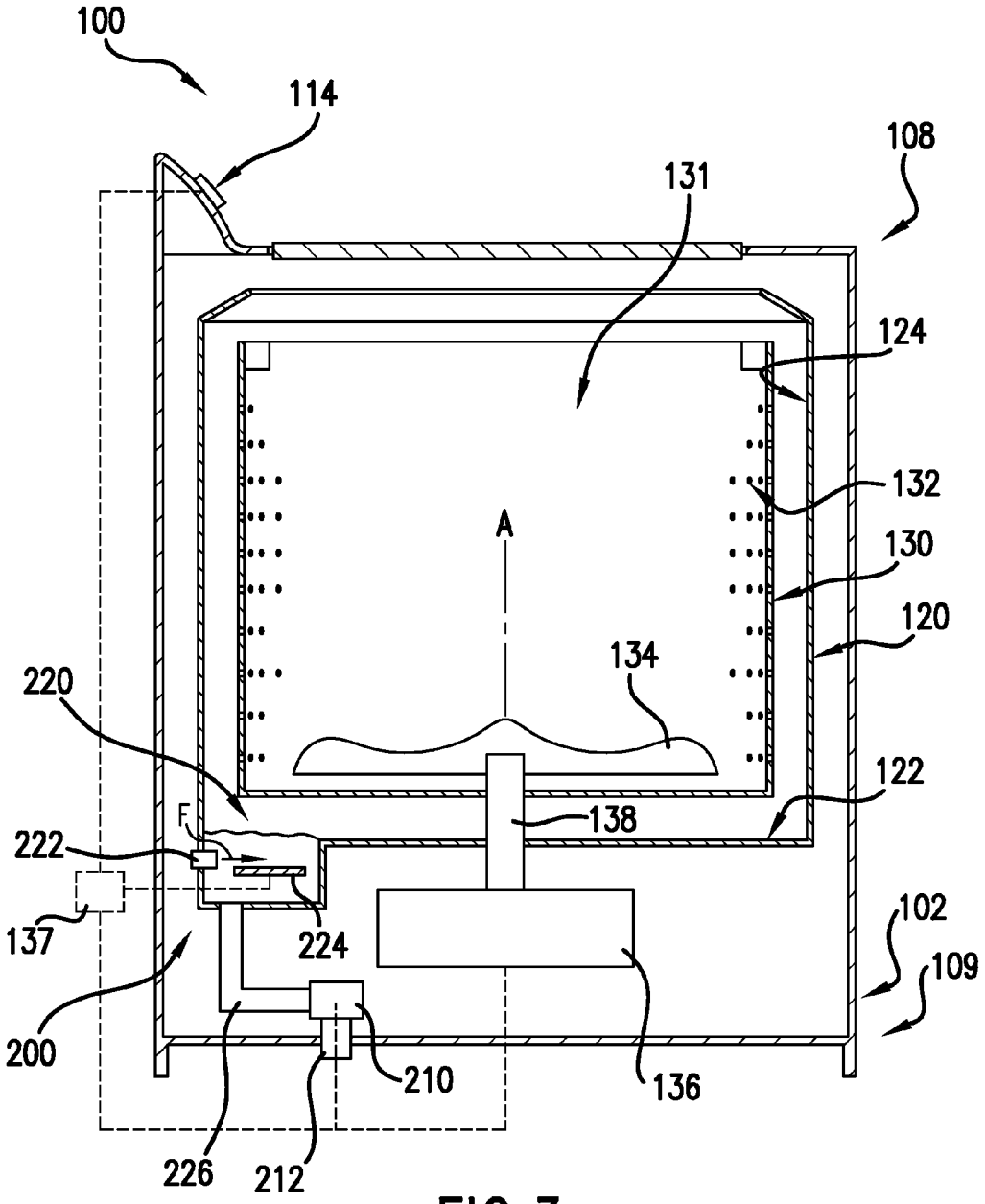
FIG. 3 provides a cross-sectional view of the washing machine appliance of FIG. 1 and particularly illustrates the sump of the appliance filled with stream generation fluid.

FIGS. 2 and 3 provide partial cross-sectional views of the exemplary washing machine 100 of FIG. 1. As shown, wash tub 120 includes a bottom wall 122 and a sidewall 124. Bottom wall 122 of wash tub 120 is positioned adjacent to bottom 109 of cabinet 102. A wash basket 130 is rotatably mounted within wash tub 120. Wash basket 130 defines a wash chamber 131 configured for receipt of articles for washing. A pump 210 is located beneath tub 120 and wash basket 130 for gravity assisted flow of wash fluid within wash tub 120 to drain 212 as discussed in greater detail below. Wash basket 130 includes a plurality of perforations 132 therein to facilitate fluid communication between an interior of wash basket 130 and wash tub 120.

An agitation element 134, such as a vane agitator, impeller, auger, or oscillatory basket mechanism, or some combination thereof, is disposed in basket 130 to impart an oscillatory motion to articles and liquid in basket 130. In different embodiments, agitation element 134 includes a single action element (i.e., oscillatory only), double action (oscillatory movement at one end, single direction rotation at the other end) or triple action (oscillatory movement plus single direction rotation at one end, singe direction rotation at the other end). As illustrated in FIGS. 2 and 3, agitation element 134 is oriented to rotate about a vertical axis A. Basket 130 and agitator 134 are driven by pancake motor 136. As motor output shaft 138 is rotated, basket 130 and agitation element 134 are operated for rotatable movement within wash tub 120. Washing machine 100 may also include a brake assembly (not shown) selectively applied or released for respectively maintaining basket 130 in a stationary position within tub 120 or for allowing basket 130 to spin within tub 120.

It should be appreciated that the subject matter disclosed herein is not limited to any particular style, model, or other configuration of washing machine appliance, and that the embodiment depicted in FIG. 1 is for illustrative purposes only. In addition, it should be understood that the subject matter disclosed herein is not limited to washing machine appliances and may be utilized, e.g., in dishwasher appliances or any other suitable appliances.

Operation of machine 100 is controlled by a controller or processing device 137 that is operatively coupled to control panel 112 located on backsplash 110 for user manipulation to select washing machine cycles and features. In response to user manipulation of input selectors 114, controller 137 operates the various components of machine 100 to execute selected machine cycles and features. Controller 137 may include a memory and microprocessor, CPU or the like, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Controller 137 may be positioned in a variety of locations throughout washing machine appliance 100. Input/output ("I/O") signals may be routed between the control system and various operational components of appliance 100 as discussed in greater detail below.

In an illustrative embodiment, laundry items are loaded into wash chamber 131, and washing operation is initiated through operator manipulation of control input selectors 114. Wash tub 120 is filled with water and mixed with detergent to form a wash fluid. One or more valves (e.g., an inlet 222) can be controlled by washing machine 100 to provide for filling tub 120 to the appropriate level for the amount of articles being washed. Once tub 120 is properly filled with fluid, the contents of the basket 130 are agitated with agitation element 134 for cleansing of laundry items in basket 130. More specifically, agitation element 134 is moved back and forth in an oscillatory motion.

After the agitation phase of the wash cycle is completed, tub 120 is drained. Laundry articles can then be rinsed by again adding fluid to wash tub 120, depending on the particulars of the cleaning cycle selected by a user, agitation element 134 may again provide agitation within basket 130. One or more spin cycles may also be used. In particular, a spin cycle may be applied after the wash cycle and/or after the rinse cycle in order to wring wash fluid from the articles being washed. During a spin cycle, basket 130 is rotated at relatively high speeds. In addition, during certain cycles, steam may be introduced into wash chamber 131, e.g., to assist in cleaning articles disposed therein. For example, prior to agitating articles, such articles may be saturated with steam to assist in cleaning the articles.

To assist in cleaning articles disposed in wash basket 130, washing machine appliance 100 includes a steam assembly 200 disposed adjacent the bottom 109 of cabinet 102. Steam assembly 200 includes a sump 220 defined by bottom wall 122 of wash tub 120. Sump 220 is in fluid communication with wash tub 120 such that fluid in the wash tub 120 can settle in sump 220 during operation of appliance 100. Thus, sump 220 can collect fluid during operation of appliance 100. Drain pump 210 is in fluid communication with sump 220 via piping 226. Drain pump 210 is configured for assisting in directing fluid from sump 220 to a drain 212 (shown with arrow W in FIG. 2). For example, pump 210 may urge (i.e., pump) fluid from sump 220 to drain 212 in order to drain wash tub 120 of fluid.

In addition, a heater 224 is disposed within sump 220. Heater 224 is configured for selectively adjusting (e.g., increasing) a temperature of fluid within sump 220. For example, heater 224 may heat fluid in sump in order to generate steam. Steam generated in sump 220 by heater 224 can assist in cleaning articles disposed within wash basket 130.

Inlet 222 is in fluid communication with wash tub 120 in order to selectively direct fluid into wash tub 120 (shown with arrow F in FIGS. 2 and 3). In FIGS. 2 and 3, inlet 222 is positioned adjacent sump 220. By positioning inlet 222 adjacent sump 220, during addition of fluid to wash tub 120, articles disposed in wash basket 130 may not become saturated with fluid entering wash tub 120 from inlet 222. However, in alternative, embodiments, inlet 222 may be positioned at any suitable location, e.g., adjacent top 108 of cabinet 102. By way of example, inlet 222 may be a valve or other device for allowing a flow of fluid into sump 220.

In FIG. 2, sump 220 is shown filled with wash fluid. Such wash fluid may contain, e.g., water, detergent, lint, dirt, soil, and/or other particles or contaminants P. Sump 220 can fill with wash fluid, e.g., after a wash cycle, after a rinse cycle, or after draining wash tub 120 of wash fluid. For example, after using drain pump 210 to drain wash tub 120 of wash fluid, wash fluid in piping 226 may backflow into sump 220 due to gravity.

In FIG. 3, sump 220 is filled with steam generation fluid. Steam generation fluid may contain, e.g., mostly water (i.e., clean water). Sump 220 can fill with steam generation fluid after drain pump 210 drains sump 220 of wash fluid and inlet 222 is opened to release water into sump 220. During generation of steam, heater 224 can be submerged in steam generation fluid as shown in FIG. 3 rather than washing fluid as shown in FIG. 2. By submerging heater 224 in steam generation fluid rather than washing fluid, steam generated by heater 224 can be cleaner and thus more efficiently clean articles disposed in wash chamber 131. Also, heater 224 may not burn lint and/or other contaminants in washing fluid during steam generation. The steam generation fluid can also be delivered warm or heated—so as to provide preheating of the sump 220 in preparation for steam generation.

Figure 4:
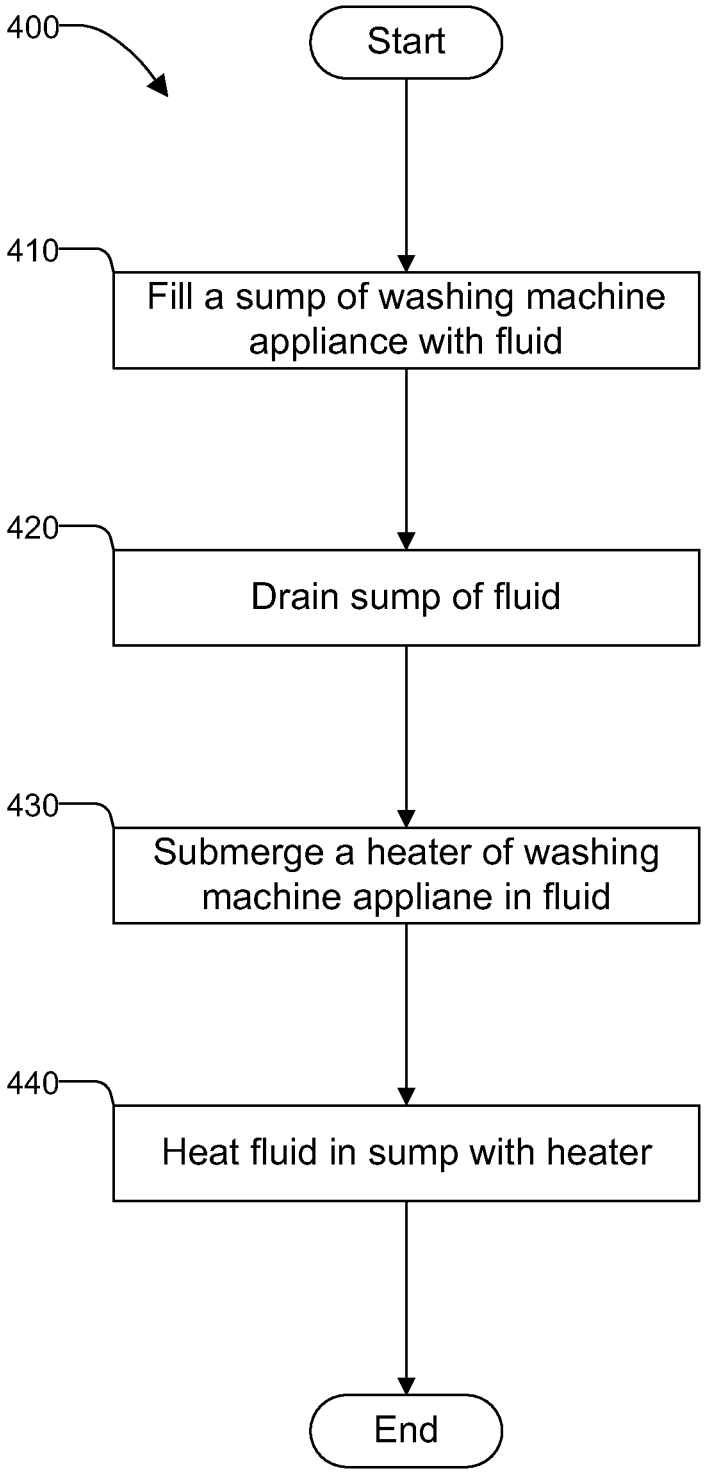
FIG. 4 provides a method for operating a washing machine appliance according to an exemplary embodiment of the present subject matter.

FIG. 4 provides a method 400 for operating a washing machine appliance, e.g., washing machine appliance 100. Method 400 includes filling a sump of a washing machine appliance with fluid (410), draining the sump of fluid (420), submerging a heater of the washing machine appliance in fluid after the step of draining (430), and heating the fluid in the sump with the heater in order to generate steam (440). Method 400 shown in FIG. 4 may be carried out, e.g., by controller 137 of washing machine appliance 100. Thus, controller 137 may be programmed to carry out steps of method 400. Accordingly, controller 137 is in operative communication with heater 224, inlet 222, and pump 210. By carrying out the steps of method 400, sump 220 filled with washing fluid as shown in FIG. 2 may be refilled with steam generation fluid as shown in FIG. 3.

At 410, controller 137 may adjust inlet 222 in order to fill sump 220 with fluid (shown with arrow F in FIG. 2), e.g., water from a water supply (not shown). At 410, washing fluid from e.g., piping 226 may still be disposed in sump 220 as discussed above. By adding fluid from inlet 222, such washing fluid can be diluted and/or rinsed from sump 220. Thus, it should be understood that filling sump 220 with fluid does not require a specific amount of fluid. Rather, any suitable amount of fluid may be added to sump 220 at 410 in order to dilute washing fluid disposed in sump 220 and/or rinse washing fluid from sump 220. Alternatively, at 410, no washing fluid may be disposed in sump 220 and filling sump 220 with fluid may mean adding fluid to sump 220 in order to rinse or clean sump 220.

At 420, controller 137 may activate pump 210 in order to drain sump 220 of fluid (shown with arrow W in FIG. 2). Thus, pump 220 may direct fluid via piping 226 to drain 212. It should be understood that steps 410 and 420 may be conducted simultaneously. Thus, inlet 222 may be opened such that fluid is entering sump 220 while pump 210 is actively removing such fluid from sump 220. Alternatively, inlet 222 may be closed prior to activating pump 210, and pump 210 may remove fluid disposed in sump 210 by inlet 222 during step 410. At 420, pump 210 may remove fluid disposed in sump 210 until washing fluid (e.g., as shown in FIG. 2) is substantially removed from sump 210 and from piping 226. Thus, pump 210 may remove fluid disposed in sump 210 until washing fluid has exited appliance 100 via drain 212. By removing washing fluid from appliance 100, such washing fluid may not backflow into sump 220 as described above.

At 430, controller 137 may submerge heater 224 in fluid (shown with arrow F in FIG. 3). Thus, controller 137 may adjust inlet 222 in order to submerge heater 224 in fluid. By filling sump 220 with fluid at 410 and draining sump of fluid at 420, fluid submerging heater 224 may be cleaner (e.g., contain less lint, detergent, soil, and/or other contaminants or particles P). Thus, at 430, fluid submerging heater 224 may be steam generation fluid as shown in FIG. 3 (e.g., substantially clean water). In addition, at 430, controller 137 may also deactivate pump 210 in order to terminate the flow of fluid to drain 212. Also, controller 137 may adjust inlet 222 such that fluid is flowing into sump 220 for a predetermined amount of time that is necessary for heater 224 to be submerged by fluid entering sump 220 from inlet 222. The predetermined amount of time may be calculated based on a flow rate of fluid through inlet 222. Alternatively, a fluid level detector (not shown) may be used to determine when heater 224 is submerged with fluid.

In addition, at 410 or 430 heated fluid (e.g., heated water from a hot water heater) may be used to fill sump 220 or submerge heater 224 respectively. Heated fluid can decrease the amount of energy needed to generate steam. For example, heated fluid can preheat heater 224 prior to starting heater at 440 as described below.

At 440, controller 137 may start heater 224 in order to heat fluid in sump 220. By heating fluid in sump 220, steam may be generated. Such steam may enter wash chamber 131, e.g., in order to assist in cleaning articles disposed therein and/or assist in eliminating wrinkles and/or unpleasant odors.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A vertical axis washing machine appliance comprising:

a cabinet;

a wash tub received in said cabinet and configured for containing a fluid used in a washing process, said wash tub extending between a bottom portion and a top portion;

a wash basket mounted in said wash tub, said wash basket configured for the receipt of articles during the washing process and for rotation about a substantially vertical axis;

a sump positioned adjacent the bottom portion of said wash tub, said sump also in fluid communication with said wash tub;

a heater positioned adjacent or within said sump and configured for selectively adjusting a temperature of fluid in said sump;

an inlet conduit extending to said sump;

a valve coupled to said inlet conduit, said valve configured for regulating fluid flow through said inlet conduit and permitting selective addition of fluid to said wash tub though said inlet conduit, an outlet of said inlet conduit positioned at the sump such that fluid exits the outlet of said inlet conduit and flows into said sump without passing through said wash basket;

a drain conduit extending from said sump;

a pump in fluid communication with said sump via said drain conduit, said pump configured for selective draining of fluid from said sump through said drain conduit; and a processing device in communication with said heater, said valve, and said pump, wherein said processing device is configured for:

opening said valve at a start of a steam clean cycle in order to direct fluid from said inlet conduit into said sump;

activating said pump during the steam clean cycle prior to activating said heater in order to drain said sump of the fluid directed into said sump at said step of opening and rinse said sump;

operating said valve during the steam clean cycle such that fluid from said inlet conduit flows into said sump and submerges said heater directly after said step of activating; and starting said heater during the steam clean cycle in order to heat and generate steam with the fluid in said sump from said step of operating.

2. The washing machine appliance of claim 1, wherein said wash tub defines said sump.

3. The washing machine appliance of claim 1, wherein said processing device is further configured for deactivating said pump after a period of time has elapsed.

4. The washing machine appliance of claim 3, wherein the period of time corresponds to a period of time sufficient to drain said sump of fluid.

5. The washing machine appliance of claim 1, wherein said processing device is further configured for readjusting said valve in order to terminate a flow of fluid to said wash tub after a period of time has elapsed.

6. The washing machine appliance of claim 5, wherein the period of time corresponds to a period of time sufficient to fill said sump with fluid.

7. The washing machine appliance of claim 5, wherein the period of time corresponds to a period of time sufficient to submerge said heater with fluid.

8. The washing machine appliance of claim 1, wherein heated fluid is directed into said sump at said step of opening.

9. A vertical axis washing machine appliance, comprising:

a cabinet;

a wash tub disposed within said cabinet, said wash tub configured for containing fluid therein, said wash tub extending between a bottom portion and a top portion, said wash tub defining a sump at the bottom portion of said wash tub;

a wash basket disposed within said wash tub such that said wash basket is rotatable about a substantially vertical axis within said wash tub;

a heater positioned at the sump of said wash tub, said heater operable to adjust a temperature of fluid within the sump of said wash tub;

an inlet conduit mounted to said wash tub at the bottom portion of said wash tub, an outlet of said inlet conduit positioned at the sump of said wash tub such that fluid from said inlet conduit flows directly into the sump of said wash tub;

a valve coupled to said inlet conduit, said valve configured for regulating fluid flow through said inlet conduit;

a pump;

a drain conduit mounted to said wash tub at the sump of said wash tub, said drain conduit extending from said wash tub to said pump, said pump operable to drain fluid from the sump of said wash tub via said drain conduit; and a controller in communication with said heater, said valve, and said pump, said controller comprising a memory in communication with a processor, the memory including instructions to be executed by the processor, the instructions comprising:

adjusting said valve in order to direct fluid from said inlet conduit into said sump at a start of a steam cycle;

activating said pump during the steam cycle prior to activating said heater in order to drain the fluid directed into said sump during said step of adjusting from said sump and rinse said sump;

utilizing said valve in order to refill said sump with fluid during the steam cycle such that said heater is submerged in fluid, said heater being deactivated during the steam cycle between said steps of activating and utilizing; and after said step of utilizing, starting said heater in order to heat the fluid in said sump and generate steam during the steam cycle.

10. The washing machine appliance of claim 9, wherein said step of adjusting comprises filling said sump with heated fluid.

* * * * *